United States Patent [19]

Arnet

[11] Patent Number: 4,982,458

[45] **Date of Patent: * Jan. 8, 1991**

[54] DRIP TRAY

[76] Inventor: Wolfgang Arnet, 5/33 Elaine Avenue, Avalon Beach, New South Wales, 2107, Australia

[ * ] Notice: The portion of the term of this patent subsequent to Jun. 19, 2007 has been disclaimed.

[21] Appl. No.: 471,435

[22] Filed: Jan. 29, 1990

Related U.S. Application Data

[63] Continuation of Ser. No. 227,734, Aug. 3, 1988, Pat. No. 4,933,998.

[30] Foreign Application Priority Data

Feb. 29, 1988 [AU] Australia ..... 12369/88

[51] Int. Cl.[5] ..... A45D 44/08

[52] U.S. Cl. ..... 4/521; D28/20

[58] Field of Search ..... 4/515–523; D28/20, 9, 10; 132/333; 224/148, 265

[56] References Cited

U.S. PATENT DOCUMENTS

| | | | |
|---|---|---|---|
| D. 132,795 | 6/1942 | Sommers | D28/20 |
| D. 227,042 | 5/1973 | Altemare | D28/20 |
| 612,259 | 10/1898 | Mink | 4/522 |
| 1,429,950 | 9/1922 | Jones et al. | 4/515 |
| 4,014,054 | 3/1977 | Pasquarello | 4/521 |

FOREIGN PATENT DOCUMENTS

| | | | |
|---|---|---|---|
| 0782738 | 4/1968 | Canada | 4/515 |

*Primary Examiner*—Henry J. Recla
*Assistant Examiner*—Casey Jacyna
*Attorney, Agent, or Firm*—Edwin D. Schindler

[57] ABSTRACT

A drip tray for a solution applied to the head of a wearer of the tray, the tray having a horseshoe configuration with a central neck opening accessed through a narrower slot between arms of the tray and wherein the tray is made from a flexible material permitting the slot to be widened to allow the tray to be mounted on the neck of a wearer, the tray has a trough cross-sectional with a grossly depressed floor portion at substantially the mid-length position of the trough to provide a solution receiving well.

3 Claims, 5 Drawing Sheets

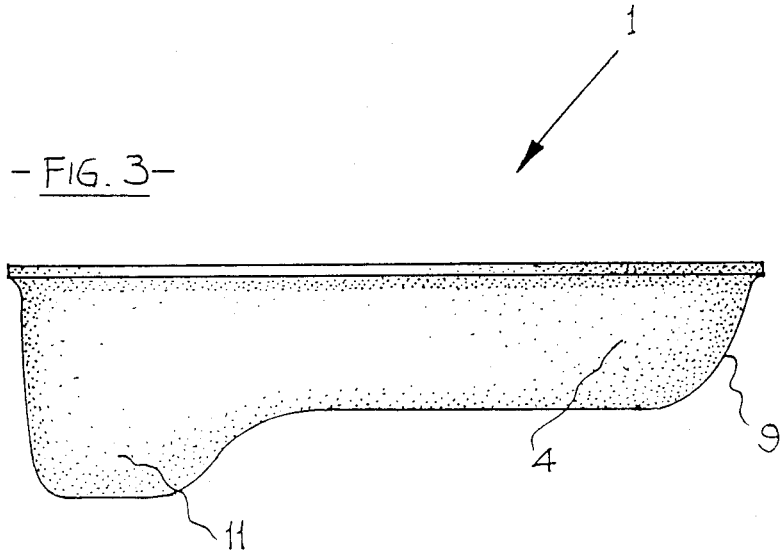
- FIG. 3 -
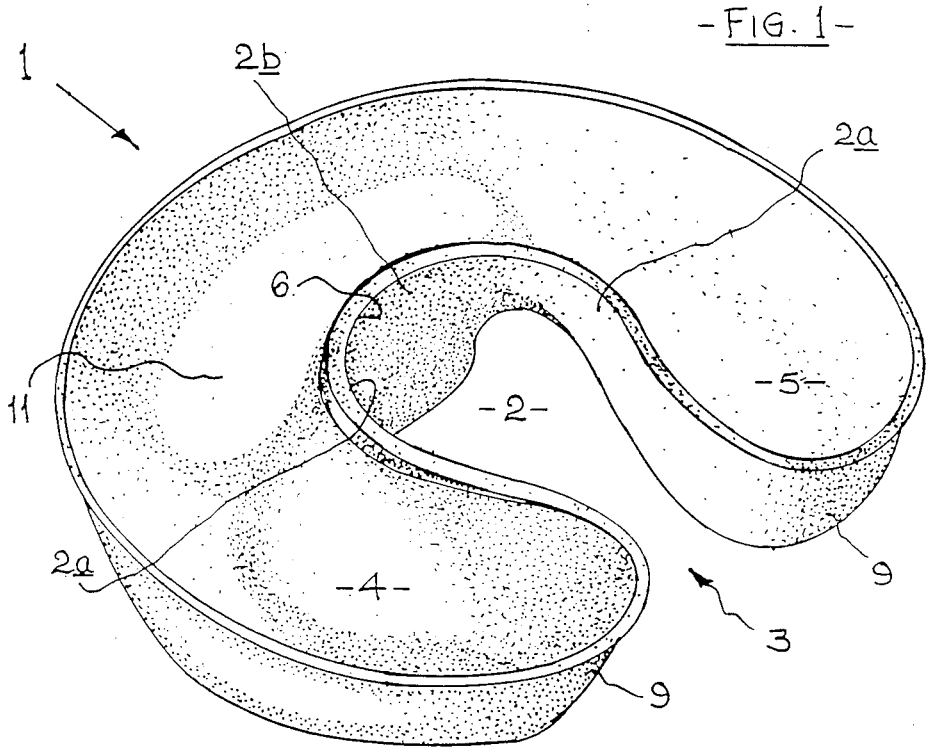
- FIG. 1 -

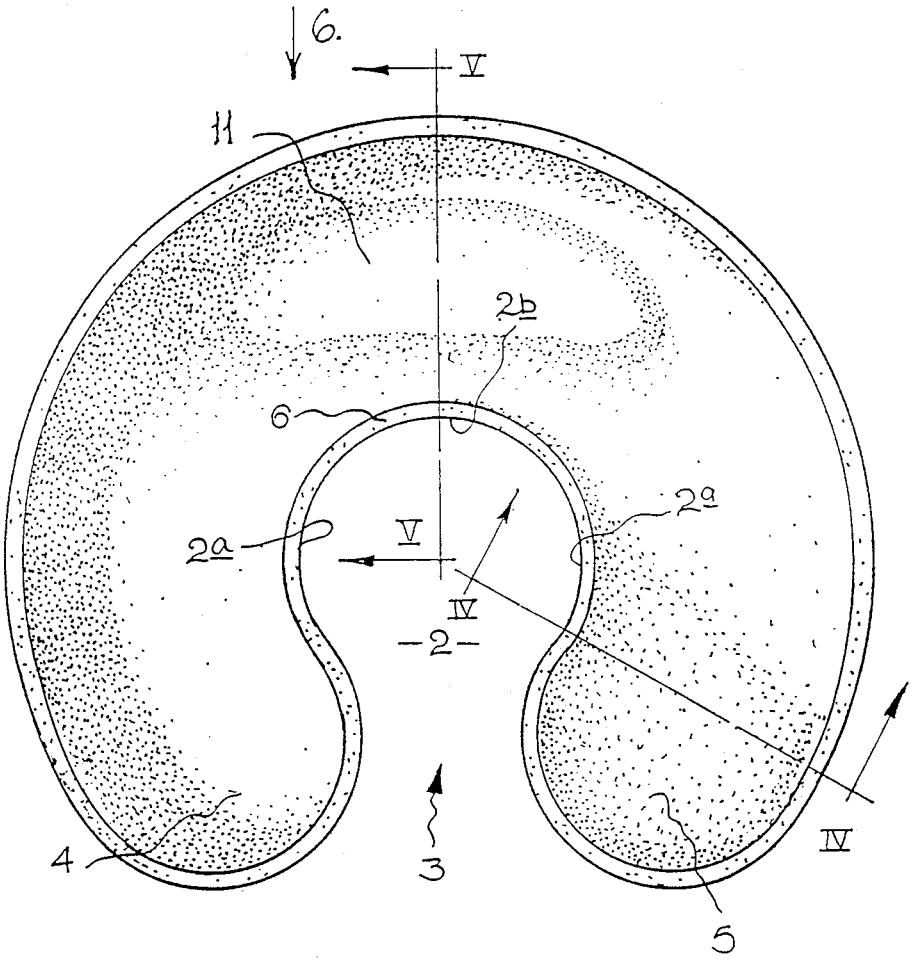
-FIG. 2-
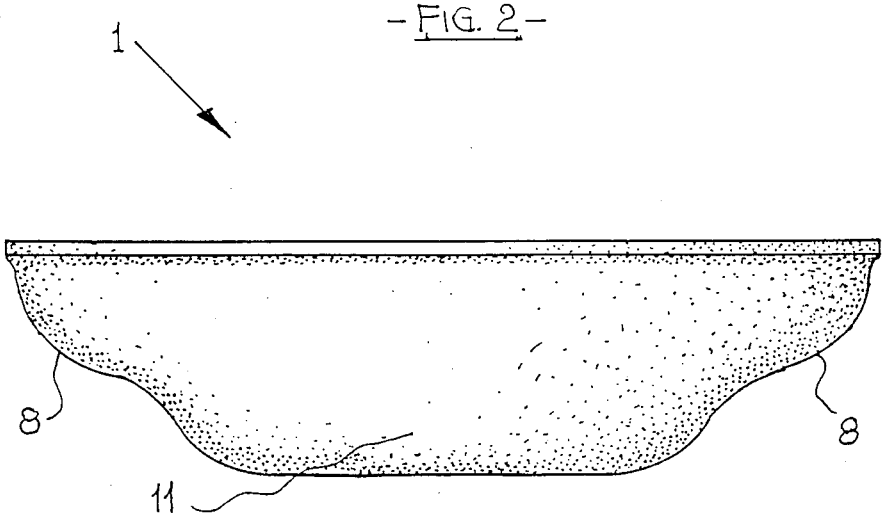
-FIG. 6-

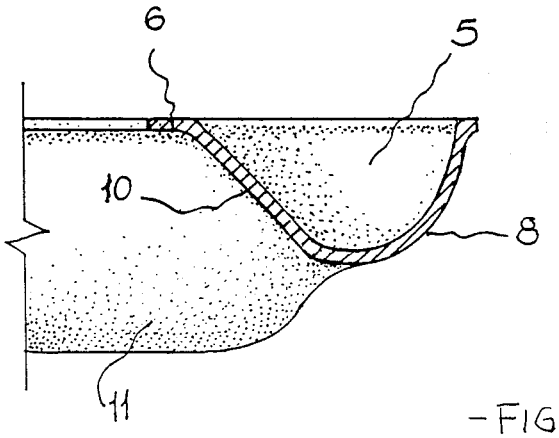
-FIG. 4-
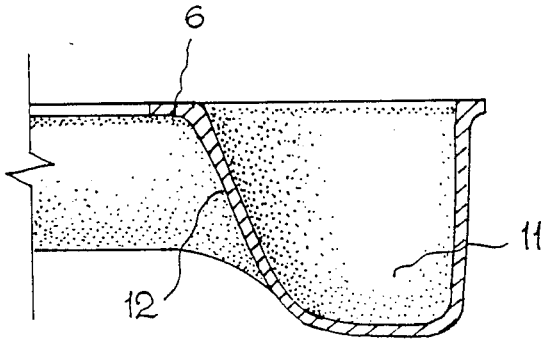
-FIG. 5-

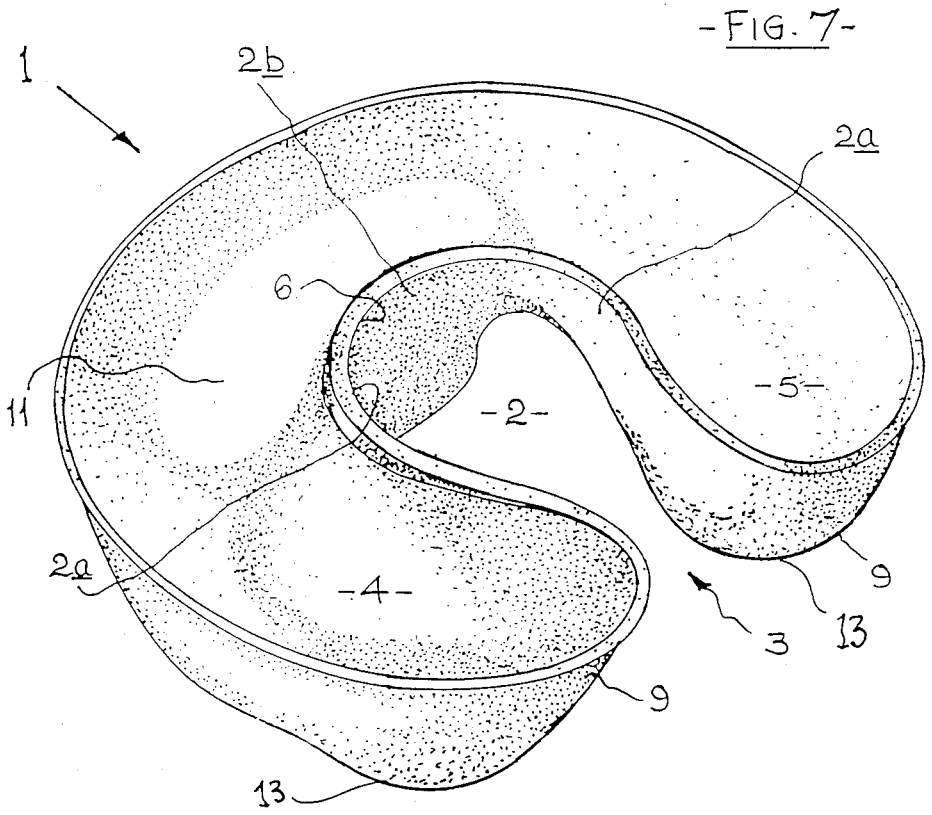
-FIG. 7-
1
2b
2a
6
11
-2-
-5-
2a
-4-
9
13
3
9
13

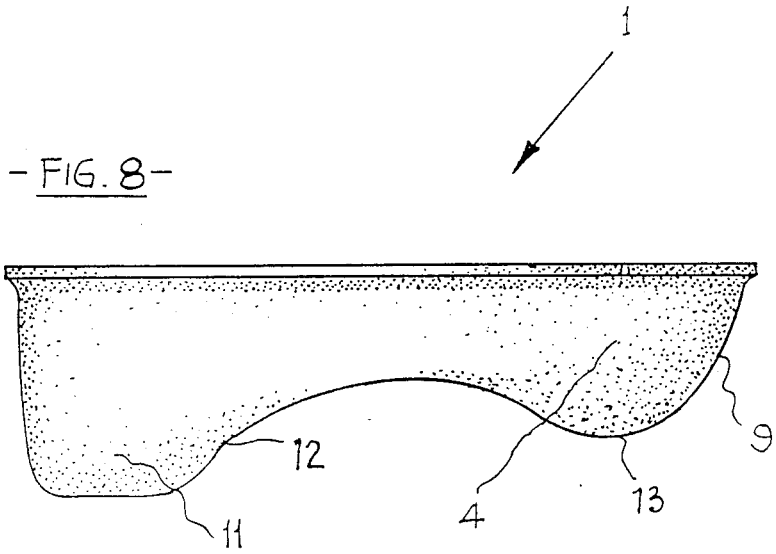
-FIG. 8-
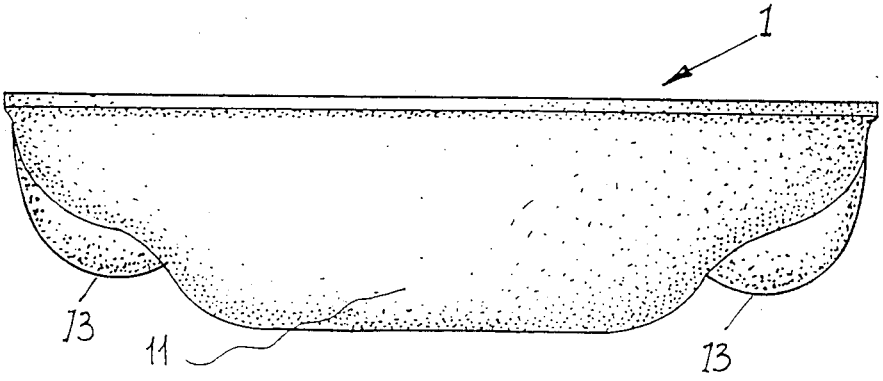
-FIG. 9-

DRIP TRAY

This application is a continuation of application Ser. No. 277,734, filed Aug. 3, 1988, now U.S. Pat. No. 4,933,998.

This invention relates to a drip tray for use by person during part of a permanent hair waving treatment. During such a treatment a permanent waving solution is applied to the hair and the amount of solution applied is always in excess cf that actually taken up by the hair of the person. As a result there is a surplus of solution that will, if not trapped in a satisfactory manner, run down the neck of the person and cause discomfort. In the past it has been common to wrap a towel around the neck of the person to trap surplus solution.

A prime object of the invention is to provide a tray adapted to be a tight but comfortable fit about a major portion of the neck of a person during the application of permanent waving lotion to the hair of the person and to collect surplus lotion.

Another object is to provide a well in the tray to collect the majority of any lotion in the tray thereby enabling the wearer to engage in limited inclining of the head and neck without loss of the lotion from the tray.

Yet another object of the invention is to provide a tray having a shape on the underface which will ensure the tray will be supported in a stable manner on the shoulders of a wearer so that the upper face of the tray will be substantially horizontal when the wearer has her head and neck upright.

These and other novel aspects of the invention will be understood from the following description of the invention which can be broadly defined as a drip tray made from flexible material to collect liquid applied to a head of a wearer of the tray which is in excess of that required for a hair treatment, said tray including an opening dimensioned to embrace a substantial portion of the neck of a wearer with an neck access slot extending radially from the opening, said slot being narrower than the width of the opening necessitating flexible manipulation of the tray to widen the slot the permit neck access to said opening, said tray in cross-section being of trough configuration with a section of the bottom of the trough opposite said slot grossly depressed to provide a liquid receiving well in the trough.

Two presently preferred embodiments of the invention will now be described with reference to the accompanying drawings in which:

FIG. 1 is a perspective view of the first embodiment of the drip tray,

FIG. 2 is a plan view of the tray of FIG. 1,

FIG. 3 is a side view of the tray of FIG. 1,

FIG. 4 is a fragmentary sectional elevation on the section line IV—IV of FIG. 2, FIG. 5 is a fragmentary sectional elevation on the section line V—V of FIG. 2, FIG. 6 is an end view in the direction of the arrow 6 of FIG. 2, FIG. 7 is a perspective view of the second embodiment of the drip tray, FIG. 8 is a side view of the tray of FIG. 7 and FIG. 9 is a view in the direction of the arrow 9 of shown in the FIG. 7.

Referring to the drawings if the first embodiment, FIGS. 1 to 6, the tray 1 of the invention is somewhat of horseshoe shape and of trough cross-sectional shape. Whilst the horseshoe shape is convenient and aesthetically pleasant to the eye it is to understood that the tray can be shaped other than as a horseshoe. There is a central opening 2 with curved opposed sides **2*a* and a curved back 2*b* having a radius of curvature somewhat larger than that of the sides 2*a*. The difference in radii is to allow the sides of the opening to relate to the dimensions of a normal human neck where the back of the neck most commonly has a curvature of radius larger than the radius of the curvature of the sides of the neck. The opening 2 is accessed by the neck of a potential user via a slot 3 bounded by side portions 4 and 5 of the tray. The width of the slot 3 is desirably less than the maximum width of the opening between the sides 2*a*** thereof.

The opening 2 is dimensioned to suit a range of neck sizes commonly encountered in persons of average build and weight. It is to be understood that the tray will be manufactured from a plastics material that is soft to the touch so that even when tightly embracing the neck of a user there will be no discomfort. The material of manufacture is flexible and resilient so that the side portions 4 and 5 can be spread apart to enlarge the slot 3 to allow the neck of a used to enter the opening 2. A suitable plastics material would be a closed cell polyethylene foam material.

To facilitate the fit of the tray around a neck the inner edge 6 of the opening 2, see FIGS. 4 and 5, is an extended flap that can in use deflect to accommodate irregularities in neck configuration and variations in size within the predetermined range for which the particular tray has been designed.

The trough-like form of the tray is generally of the same width throughout. From FIG. 6 it will be seen that the outer profile 8 of the side portions 4 and 5 is of generally part-circular shape and the free ends 9 of the side portions 4 and 5 are similarly shaped, see FIG. 3. The inner profile of the side portions 4 and 5 as indicated 10 is angularly inclined and is intended to accommodate the shape of that portion of the body of a user where the sides of the neck of a user and the tops of the shoulders join. In this way the tray will tend to be supported in a stable manner on the neck and shoulders of the user. If, as is sometimes the custom, a towel is placed around the lower neck of a user the profiled surfaces 10 would rest upon the towel. It will be understood that where the tray is of shape other than horseshoe the foregoing description as applied to the surfaces surface profile 10 would still be applicable whilst the outer profile 8 of the side portions can be other than part circular.

The rear section of the trough is grossly extended downwardly so as to provide a well 11 to hold liquid. Referring to FIG. 4 it will be seen that the inner surface of the well 11 as indicated 12 is spaced rearwardly of the flange 6 and this there will be a clearance between the back of the neck of the user and the surface 12. However the depth of the well 11 is such that there will be only a small clearance between the bottom of the well and the back of a user. If the well accumulates a large amount of liquid the bottom of the well will come into contact with the back of the user thereby maintaining the top of the tray substantially horizontal so long as the neck and head of the user remain substantially upright.

It is to be understood that there is usually only a small surplus of liquid to be collected in the tray. Preferably the tray is shaped so that when the upper surface of the tray is horizontal there is a slight down angle of the trough floor towards the well to encourage substantially all surplus liquid which deposits in the trough to flow to the well 11. It follows from the foregoing that if the user were to tilt her head and neck forward to a reasonable degree there is little liklihood of any spillage of liquid from the well.

In the second embodiment, as illustrated in FIGS. 7 to 9, stable mounting of the tray on the shoulders of the user is promoted by the addition of downwardly directed portions of the trough bottom indicated 13. As will be seen, praticularly from FIGS. 8 and 9, the portions 13 and the front face of the 12 of the well 11 provide abutments to engage the front and rear of the shoulders of a user and locate the tray and prevent it from unintended rearward movement, although such movement would be resisted by the narrowness of the slot 3. With the improvement of the portions 13 a large amount of liquid can be accommodated in the well 11 without the weight of that liquid causing rearward movement bias of the tray when mounted on a user.

I claim:

1. A drip tray for use in hairdressing for mounting around the neck of a wearer for collecting excess liquid applied to the head of the wearer and being made of flexible material and comprising:

a U-shaped configuration defining a trough which is symmetrical with respect to a centerline and has a bridging portion and opposite leg portions, a neck receiving opening defined by:

a curved inner edge of said bridging portion with a center of curvature on the centerline and which subtends a reflex angle with respect to the center of curvature, and end extensions of said curved inner edge comprised of a first inner edge part on each of said leg portions which first inner edge parts converge with respect to the centerline of the tray, a neck engaging lip extending along the length of the curved inner edge of the bridging portion and along the length of said first inner edge parts of said leg portions so as to provide for an embracing engagement of said engaging lip of said neck opening with a substantial portion of the circumference of the neck of the wearer of said drip tray, a neck access slot extending radially from said neck opening defined by:

oppositely positioned convexly curved second inner edge parts of the respective leg portions with a distance between proximal surfaces of said two convexly curved second inner edge parts less than the diameter of said neck opening, said trough having a U-shaped liquid receiving cross-section extending between said neck engaging lip and an outer edge of the trough; and, said trough further defining a trough floor with depressed sections in said bridging portion and adjacent the terminal ends of said leg portions forming depressed reservoirs;

said depressed reservoirs being located so as to define tray supports adapted to engage the respective shoulder portions of a user with the head in an upright position.

2. The drip tray according to claim 1, wherein said tray further includes undersurfaces adjacent said neck opening shaped to accommodate a body form of the wearer of said drip tray where the neck and shoulders of the wearer merge.

3. The drip tray according to claim 2, wherein said depressed reservoir in said bridge portion extends sufficiently below said undersurfaces of said drip tray to engage the back of the wearer of said drip tray intermediate the wearer's shoulders in order to support said drip tray when eccentrically weighed due to liquid in said depressed reservoir.

* * * * *